United States Patent [19]

Slavik et al.

[11] 4,303,056

[45] Dec. 1, 1981

[54] FIREPLACE CLOSURES

[76] Inventors: John W. Slavik, 5275 Mahoning NW., Warren, Ohio 44485; Nancy L. Shafer, 5865 Oakhill Dr., West Farmington, Ohio 44491

[21] Appl. No.: 67,757

[22] Filed: Aug. 20, 1979

[51] Int. Cl.[3] ..... F24B 7/00

[52] U.S. Cl. ..... 126/121; 126/140; 126/143

[58] Field of Search ..... 126/120, 121, 135, 140, 126/143; 237/51

[56] References Cited

U.S. PATENT DOCUMENTS

| | | | |
|---|---|---|---|
| 4,060,196 | 11/1977 | Goldsby et al. | 126/121 |
| 4,074,681 | 2/1978 | Whiteley | 126/121 |
| 4,112,914 | 9/1978 | Brown | 126/202 |
| 4,112,915 | 9/1978 | Slavik | 126/121 |
| 4,129,113 | 12/1978 | Bergstrom | 126/202 |

*Primary Examiner*—Ronald C. Capossela
*Attorney, Agent, or Firm*—Michael Williams

[57] ABSTRACT

A fireplace closure containing means for supplying an additional amount of air to assist combustion of the logs, coal and the like in the fireplace grate at the time a fire is first started. The invention includes means for cutting off the additional amount of air after the fire is burning satisfactorily. The invention is well adapted for combination with a heat exchanger having forced air circulation and in such case the forced air is first delivered under the fireplace grate to assist combustion during the start of the fire. When the fire has caught satisfactorily, the forced air is then directed through the heat exchanger and is no longer delivered to the grate area. Included in this application are means to adapt and secure a fireplace closure of standard dimensions to fireplace openings of variable dimensions.

14 Claims, 9 Drawing Figures

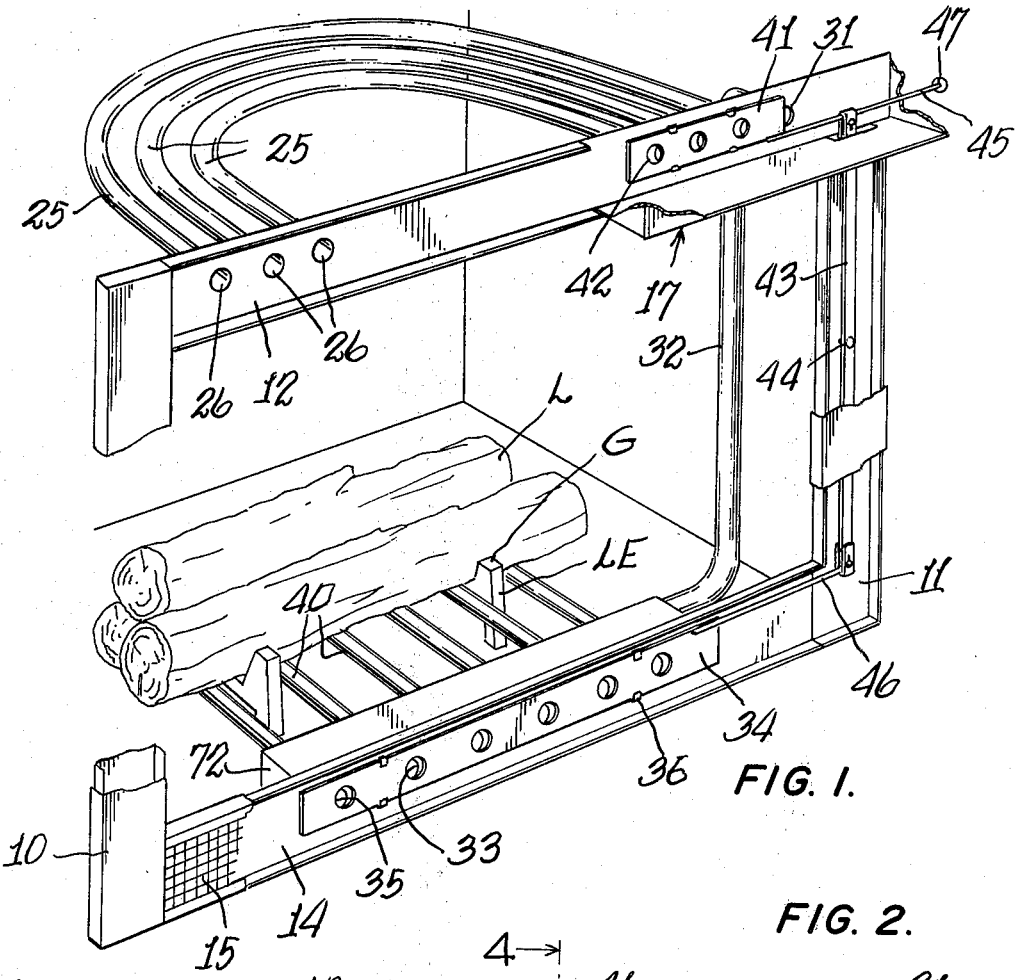
FIG. 1.
FIG. 2.
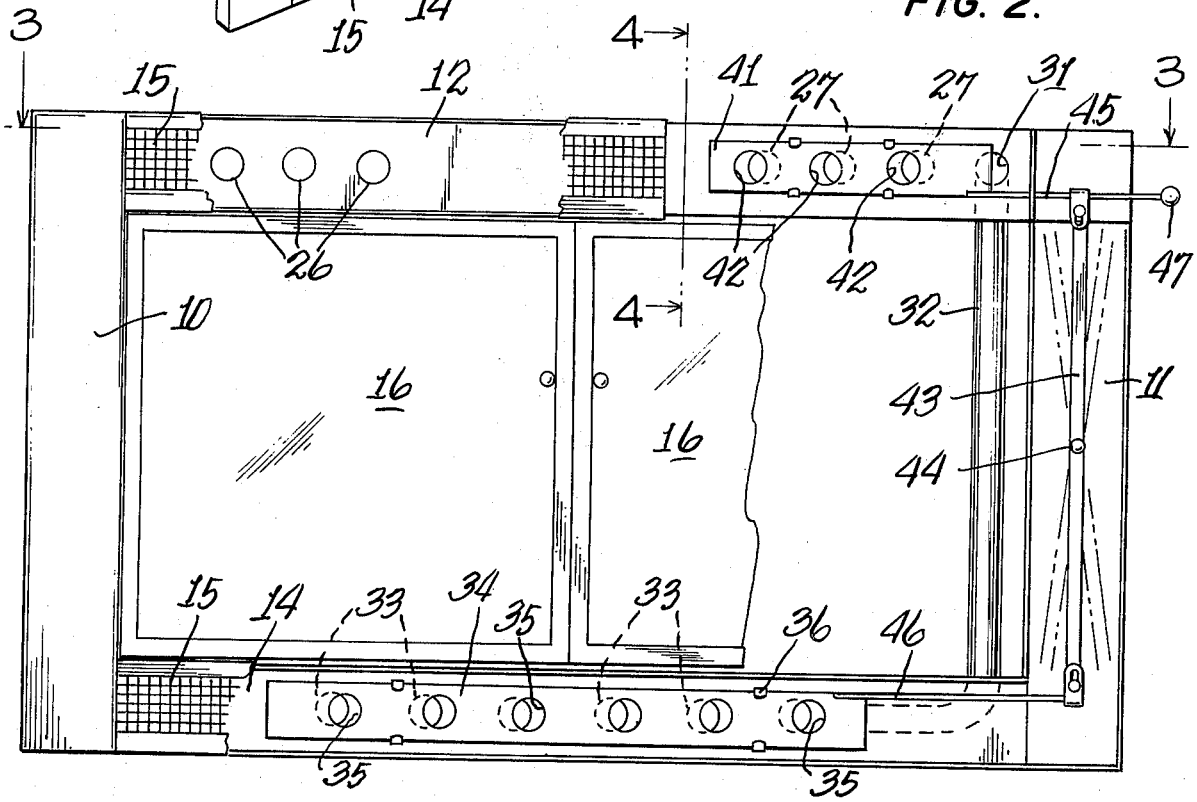

FIREPLACE CLOSURES

BACKGROUND AND SUMMARY

Starting a log fire in a fireplace can be a very exasperating chore, especially when the logs are not too well seasoned. Some fireplaces are equipped with a gas burner to supply a flame until the logs catch but these are not always satisfactory and sometimes constitute a hazard because of the danger of gas leaks.

In colonial days, a bellows was usually hung at the side of the fireplace to be used to supply forced air to the fire until it was burning satisfactorily. Nowadays, bellows are only available in a limited amount and are used primarily for decorative purposes.

Our invention incorporates structure which will provide an additional amount of air to the fire in a fireplace, the air being directed underneath the grate where it will do the most good.

Our invention is particularly well adapted for use with fireplace closures having glass screens and heat exchangers, such as disclosed in U.S. Pat. No. 4,112,915, issued to John W. Slavik on Sept. 12, 1978.

DESCRIPTION OF THE DRAWINGS

In the drawings accompanying this specification and forming a part of this application there is shown, for purpose of illustration, an embodiment which our invention may assume, and in these drawings:

FIG. 1 is a fragmentary perspective view of a fireplace with a closure and heat exchanger, FIG. 2 is a fragmentry front view of the fireplace closure.

DESCRIPTION OF THE PREFERRED EMBODIMENT

Figure 3:
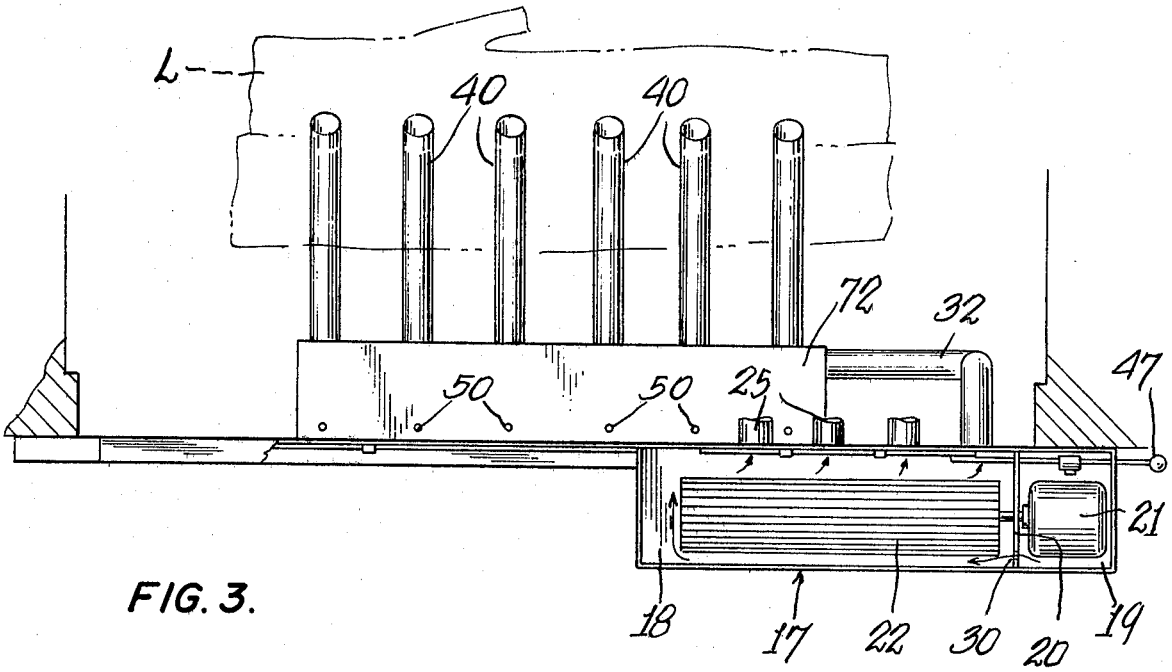
FIG. 3 is a fragmentary sectional view generally corresponding to the line 3—3 of FIG. 2.

The fireplace closure may be of the type shown in said Slavik patent and comprises spaced vertical side members 10 and 11 which are rigidly joined to top and bottom members 12 and 14 to form a self-supporting, free-standing rectangular metal frame. Decorative grills 15 preferably cover the forward-facing surface of the top and bottom members 12 and 14. A pair of glass doors 16 are hinged to the vertical members 10 and 11 and are normally closed to prevent heat loss up the chimney, but may be opened to provide access to the interior of the fireplace.

An air-blower housing 17 is carried by the closure and in the disclosed embodiment is secured to the top member 12 and extends forwardly therefrom. The housing is divided into two compartments 18 and 19 by a partition 20. An electric motor 21 is mounted in compartment 19 and has a shaft which passes through an opening in the partition. A squirrel-cage air impeller 22 is carried by the motor shaft and is disposed within the compartment 18.

A heat exchanger is carried by and concealed behind the top member 12 and, in the embodiment herein disclosed, such heat exchanger comprises a plurality of concentrically-arranged, horizontally-disposed metal tubes 25. Opposite ends of each tube communicate with respective openings 26 and 27 in the top member 12. The openings 26 are in communication with the room in which the fireplace is located, while the openings 27 communicate with the compartment 18 of the blower housing 17.

The tubes 25 are disposed within the fireplace above the logs L which are supported by a grate G which has the usual legs LE resting on the floor of the fireplace to maintain the bed of the grate and the supported logs a distance above the fireplace floor. When the motor 21 is energized, it rotates the impeller 22 which draws air from the room and forces it through the openings 27 and through the tubes 25 and causes it to be expelled through the openings 26 and back into the room in heated condition. The housing 17 has openings 30 in the compartment 19 and partition 20 so that the relatively cool air from the room is drawn up into the compartment and flows around the motor 21 to cool the same.

The top member 12 has an additional opening 31 in communication with the impeller compartment 18. A tube 32 has its upper end fixed in the opening 30 and the tube extends downwardly and has its lower end in communication with the interior of a horizontally-disposed manifold 72 which is located immediately behind the bottom member 14. A plurality of holes 33 in the bottom member are in communication with the interior of the manifold 72 and a slide damper 34 has matching holes 35 which, when aligned with the holes 33 in the bottom member, permit room air to enter the manifold. Of course when the damper 32 is moved to misalign the holes 33 and 35, the damper closes the holes 33. The damper 34 is slidably supported by ears 36 which are struck out of the bottom member, and the damper is disposed between the bottom member 14 and the decorative grills 15 in front of the member 14.

Figure 4:
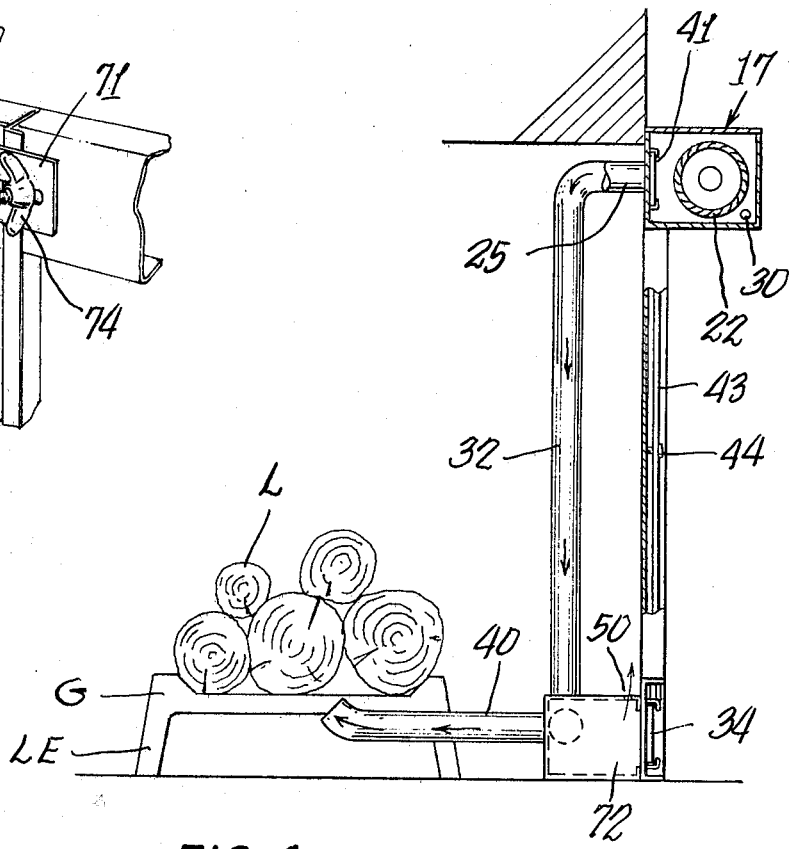
FIG. 4 is a fragmentary sectional view corresponding to the line 4—4 of FIG. 3.

Communicating with the interior of the manifold 72 and extending horizontally therefrom are a plurality of spaced tubes 40, which, as best seen in FIG. 4, have open ends inclined upwardly to direct air about midway of the logs supported on the grate.

The blower housing 17 has an interiorly-disposed slide damper 41 with holes 42 which may be aligned with the holes 27 in the top member to pass forced air into the heat exchanger tubes 25. When the holes 27 and 42 are aligned, the damper closes the hole 31 communicating with the air tube 32, and when the damper closes the holes 27, the hole 31 is uncovered. Thus, the blower 22 may either force air through the heat exchanger tubes 25 or through the air tube 32 to deliver additional air to the logs on the grate G, depending upon the position of the dampers 34 and 41.

The dampers are tied together for simultaneous movement by a lever 43 which is pivoted between its ends on a pin 44 carried by the vertical side member 11. The upper end of the lever is pivotally connected to a rod 45 which is rigidly connected to the damper 41, and the lower end of the lever is pivotally connected to a rod 46 which is rigidly connected to the damper 34. A knob 47 is provided on an exteriorly-disposed portion of the rod 45 for manipulation of the dampers. The lever connection is such that when the damper 41 closes the holes 27 and opens the hole 31, the damper 34 closes the holes 33 so that air from the blower is forced through the tube 32, into the manifold 72 and outwardly of the tubes 40 to supply additional air to the fire. As seen in FIGS. 3 and 4, the manifold 72 has small openings 50 to direct a curtain of air upwardly immediately behind the glass doors 16, and this air curtain tends to blow fly ash and dust from the interior surface of the glass doors and thus maintain such surface in clean condition.

After the fire has caught sufficiently so that it will no longer need the supplementary air for combustion, the rod 45 is operated to simultaneously move the dampers to position wherein the damper 41 closes the hole 31 and opens the holes 27, and wherein the damper 34 opens the holes 33. In such positions of the dampers, the blower 22 forces air through the heat exchanger tubes and outwardly of the openings 26 and into the room. Room air is drawn, by convection, through the holes 33 and the tubes 40 now supply the normal amount of air to the fire. It is preferred that this normal air supply be issued through the tubes 40, rather than through openings in the fireplace closure, as is customary, since the air issuing through the tubes does not stir up ashes on the floor of the fireplace.

Figure 5:
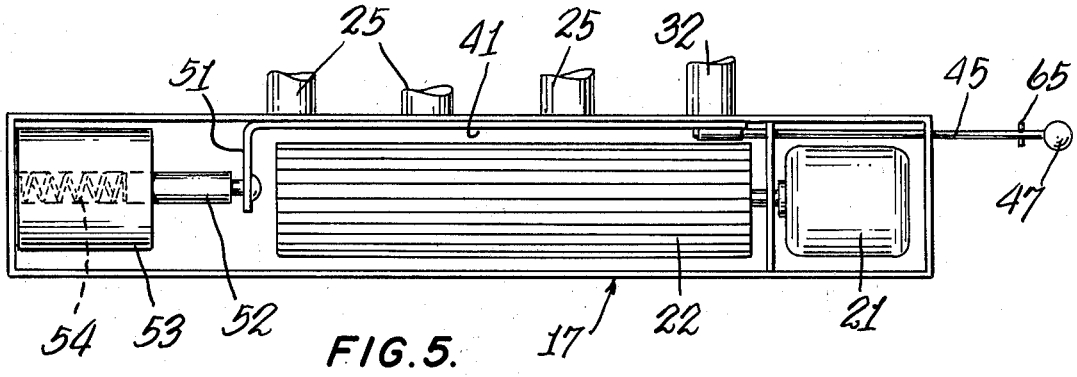
FIG. 5 is an enlarged, sectional view through the blower casing of the heat exchanger, showing parts in one position.
Figure 6:
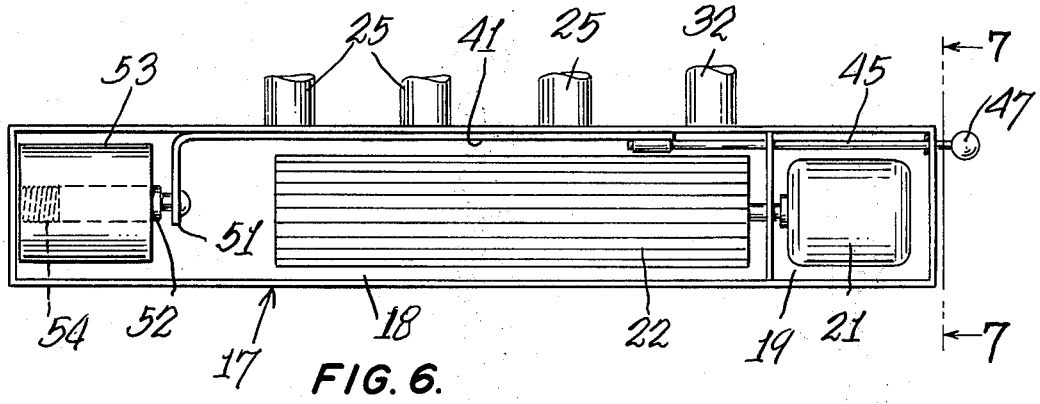
FIG. 6 is a view similar to FIG. 5, with parts in another position.
Figure 7:
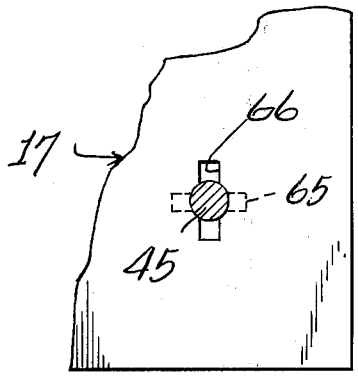
FIG. 7 is a fragmentary sectional view of a detail and generally corresponding to the line 7—7 of FIG. 6.

As shown in FIGS. 5 through 8, the dampers 34 and 41 may be automatically controlled in accordance with the temperature within the fireplace. With particular reference to FIGS. 5 and 6, the damper 41 has an angled end leg 51 to which the core 52 of a solenoid 53 is connected. When the coil of the solenoid is not energized, a coil spring 54 urges the core in a direction outwardly of the coil so that the damper 41 is urged to its right-hand position wherein it will interrupt forced air flow through the air tube 32 and permit forced air flow through the heat exchange tubes 25. In this right-hand position of the damper 41, the damper 34 will be in its left-hand position wherein the openings 33 and 35 are aligned so that air from the room is drawn through the tubes to support combustion within the fireplace.

Figure 8:
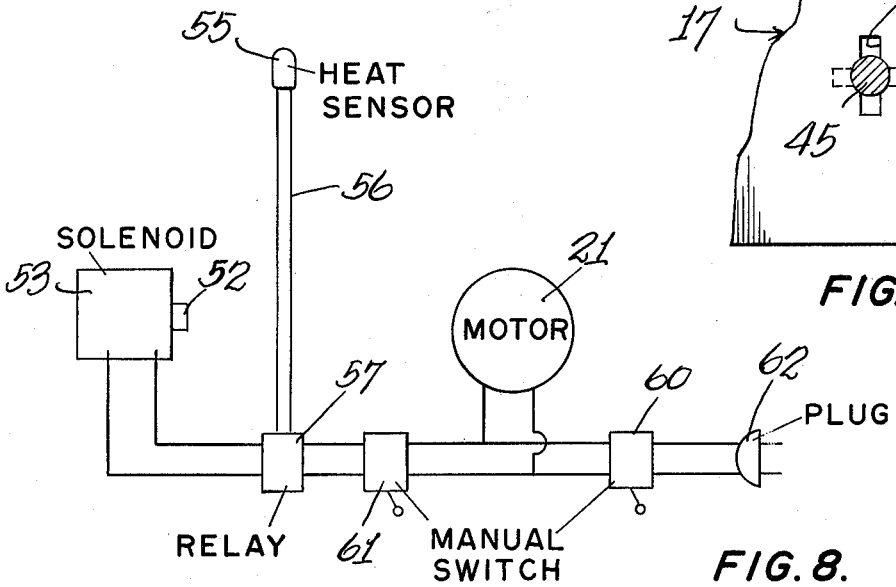
FIG. 8 is an electrical circuit diagram.

A heat sensor of any suitable type is disposed within the fireplace and in the embodiment herein disclosed, a bulb 55 is disposed in thermal transfer relationship with one of the heat exchange tubes 25 and, as seen in FIG. 8, is connected to a conduit 56 leading to a thermal relay 57. The bulb and conduit contain a fluid which expands in proportion to the amount of heat to which the bulb is subjected. The thermal relay may be of any well-known type comprising a diaphragm moved by the expansible fluid to operate switch contacts to control electric current to the solenoid coil.

The thermal relay 57 and coil of the solenoid 53 are in an electric circuit (see FIG. 8) with the motor 21 of the air blower and a pair of manual switches 60 and 61. A plug 62 is adapted to be plugged into an outlet of the usual household line, with the manual switch 60 interposed to control flow of electrical current to the motor 21 and manual switch 61.

With the switch 60 closed but the switch 61 open, only the blower motor 21 is operational. When the switch 61 is also closed and the heat in the fireplace is below a predetermined temperature (such as when the fire is just being started) the switch contacts of the thermal relay would be normally closed so that the solenoid coil is energized to draw the core 52 into the coil to pull the damper 41 to the left and push damper 34 to the right. In this position of the dampers, forced air will flow through the air tube 32 to the manifold 72 and through the horizontal tubes 40 to be expelled under the fire to assist in combustion.

When the fire has caught and is burning satisfactorily, the temperature in the fireplace will increase to a point where the fluid in the heat-sensor bulb 55 expands a sufficient amount to move the bellows in the thermal relay 57 to open the switch contacts and deenergize the solenoid coil so that the coil spring 54 extends the core to the position shown in FIG. 5, wherein the damper 41 is in position to interrupt forced air flow through the air tube 32 and permit forced air through the heat exchange tubes 25. At the same time, the damper will be moved to the position wherein it aligns the openings 33,35.

Fireplace enclosures may, or may not, incorporate the automatic control of the dampers and this choice would be dictated by cost and customer preference of manual as compared to automatic. However, when the automatic control is incorporated, provision is made for manual control and this provision need only overcome the spring action of the solenoid in the position shown in FIG. 5. In this respect, the damper rod 45 would have its right-hand end rotatable and provided with a cross pin 65 which may be disaligned with a slot 66 in the right end wall of the blower housing 17 so that the pin will bear against the inside surface of the end wall to hold the damper in the position shown in FIG. 6. The manual switch 61 will preferably be in its open position.

Figure 9:
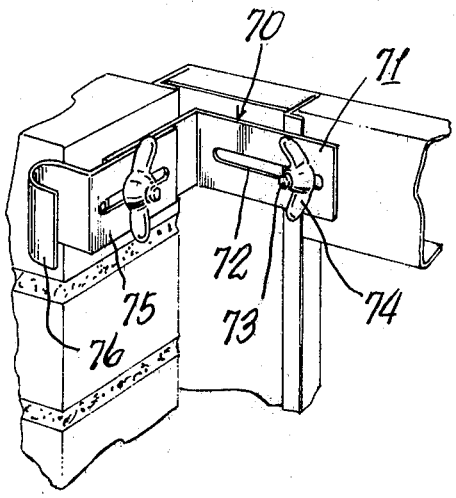
FIG. 9 is a fragmentary perspective view, illustrating means for holding a standard-size fireplace closure to fireplace openings of variable widths.

Means are provided to adapt a standard-size fireplace enclosure for use with fireplace openings of various widths, and attention is directed to FIG. 9 wherein a spring retainer member 70 is carried by a corner of the fireplace closure. This member has a first leg 71 having a horizontal slot 72 to pass a threaded pin 73 carried by the closure. A wing nut 74 is threaded on the pin and operable to hold the retainer member in a horizontally-adjusted position.

A second leg 75 extends from the leg 71 at right angle and terminates in a U-shaped end 76. The length of the leg 75 is equal to the depth of the fireplace opening so that the U-shaped end 76 will snap behind the interior of the opening to hold the closure against the front of the fireplace. In some cases, washers may have to be placed on the pin 73 between the leg 71 and the interior of the closure to extend the U-shaped end 76 sufficiently to hook behind the interior of the fireplace opening. The retainer member 70 is preferably formed of spring metal and one may be disposed at each of the four corners of the closure. The second leg 75 may be made adjustable in length, as shown, to accommodate various depths at the fireplace opening.

We claim:

1. A fireplace front for spanning the opening into a fireplace, said front comprising a metal frame having connected top, bottom and side strips defining a frame opening, and glass doors within said frame opening to provide access to the fire in said fireplace, a motor-driven blower, said bottom strip having a plurality of openings therein to permit passage of room air by convection, a conduit extending from the outlet of said blower, and tube means, having one end adapted to receive air selectively by either convection through said bottom strip openings or by blower-forced air through said conduit, said tube means having another end open and extending into said fireplace with said open end directed toward the fire therein, whereby the start of said fire may be assisted by blower-forced air until the fire has caught on, and thereafter combustion may be maintained only by convection air.

2. The construction according to claim 1 and further including a first damper for controlling flow of air through said conduit and a second damper for controlling flow of air through the openings in said bottom strip.

3. The construction according to claim 2 and further including means for automatically moving said dampers in accordance with the condition of the fire in the fireplace, to close said first damper and open said second damper when the fire is burning with sufficient intensity, to thereby interrupt flow of air through said conduit and to permit air to be drawn through the openings in said bottom strip and fed to the fire through said tubes.

4. The construction according to claim 1 wherein each of said tubes is connected to a manifold and wherein the latter is connected to said conduit, said manifold having a plurality of upwardly facing openings to permit air to blow upwardly and behind said glass doors when they are closed to blow fly ash and the like from the interior surface of said glass doors.

5. A fireplace front for spanning the opening into a fireplace, comprising, a metal frame having connected top, bottom and side strips defining a frame opening, and glass doors within said frame opening to provide access to the fire in said fireplace, said top strip having at least two openings therethrough, a heat exchange tube having an intermediate portion exposed to the heat of the fire in said fireplace, said heat exchange tube having one end in communication with one of said top strip openings and its other end adapted to discharge heated air into the room in which the fireplace is located, a conduit having one end in communication with the other of said top strip openings and its other end in communication with the interior of a manifold, tube means, having one end in communication with the interior of said manifold and the other end extending into the fireplace in the vicinity of the fire therein to be in position to direct additional air onto said fire to assist in combustion, a motor-driven blower having an inlet for receiving air from said room, and an outlet for delivering forced air to both of said top strip openings, and damper means shiftable to two positions, in one position interrupting air flow through said one strip opening but permitting air to flow through said other top strip opening, so that forced air is blown onto said fire, and in another position interrupting air flow through said other top strip opening but permitting forced air flow through said heat exchange tube.

6. The construction according to claim 5 wherein said manifold has openings adapted to admit room air into its interior, and second damper means movable to control flow of room air through said manifold openings.

7. The construction according to claim 6 and further including means correlating movement of said first-named damper means with said second damper means, whereby when air flow through said one top strip opening is interrupted, the openings in said manifold are closed.

8. The construction according to claim 7 wherein said correlating means comprises a lever pivoted intermediate its ends and having one end connected to said first-named damper means and its other end connected to said second damper means.

9. A fireplace front for spanning the opening into a fireplace, comprising a metal frame having connected top, bottom and side strips defining a frame opening, and glass doors within said frame opening to provide access to the fire in said fireplace, said top and bottom strips extending horizontally and being vertically spaced by said side strips, said top strip having a first set of openings near one end and a second set of openings at the opposite end and equal in number to said first set, heat exchange tubes having their intermediate portions exposed to the heat of the fire in said fireplace, said tubes being equal in number to the sets of openings in the ends of said top strip and said tubes having their opposite ends in communication with respective sets of openings so that air may flow through said first set of openings, through said heat exchange tubes and be heated, and exit to the room in which the fireplace is located through said second set of openings, said top strip having an extra opening adjacent to said first set of openings, an air blower including a housing forming an air chamber which is in communication with said first set of openings and said extra opening, a conduit having an upper end in communication with said extra opening and a lower end in communication with the interior of a manifold, and tube means having one end in communication with the interior of said manifold and the other end disposed within said fireplace in the vicinity of the fire therein to be in position to direct additional air onto said fire to assist in combustion.

10. The construction according to claim 9 and further including a damper shiftable to two positions, in one position interrupting air flow through said first set of openings but permitting air flow through said extra opening, and in another position interrupting air flow through said extra opening but permitting air flow through said first set of openings.

11. The construction according to claim 9 wherein said bottom strip has openings therein to pass air from said rooms, said openings being in communication with the interior of said manifold.

12. The construction according to claim 10 wherein said bottom strip has openings therein to pass air from said room, said openings being in communication with the interior of said manifold, a second damper for controlling flow of air through said bottom strip openings, and a lever pivoted intermediate its ends, said pivot being carried by a side strip, opposite ends of said lever being connected to respective ones of said first-named damper and said second damper, and said lever being operable to shift said second damper to interrupt flow of room air through said bottom strip openings when first-named damper permits air flow through said extra opening.

13. The construction according to claim 9 wherein said manifold is elongated and extends along the interior of said bottom strip, said manifold having a plurality of upwardly facing openings to permit air to blow upwardly and behind said glass doors when they are closed to blow fly ash and the like from the interior surface of said glass doors.

14. The construction according to claim 9 wherein a grate is disposed within said fireplace to support logs, and said tube means comprises a plurality of side-by-side tubes with open ends under said grate and facing upwardly to blow air against the underside of said logs.

* * * * *